US011930991B2

(12) United States Patent
Wolff et al.

(10) Patent No.: US 11,930,991 B2
(45) Date of Patent: Mar. 19, 2024

(54) EVACUATION DOCK WITH FLUID MANAGEMENT

(71) Applicant: iRobot Corporation, Bedford, MA (US)

(72) Inventors: Vincent Andrew Wolff, Norfolk, MA (US); Brian W. Doughty, Framingham, MA (US); Leo Torrente, Somerville, MA (US); Travis Gschrey, Billerica, MA (US); Jack Zhang, Guangzhou (CN); Levi Fox, Salem, MA (US); Rogelio Manfred Neumann, Somerville, MA (US); Celerick Stephens, Billerica, MA (US); James J. Mahoney, Jr., Hyde Park, MA (US)

(73) Assignee: iRobot Corporation, Bedford, MA (US)

( * ) Notice: Subject to any disclaimer, the term of this patent is extended or adjusted under 35 U.S.C. 154(b) by 767 days.

(21) Appl. No.: 17/009,856

(22) Filed: Sep. 2, 2020

(65) Prior Publication Data

US 2022/0061612 A1 Mar. 3, 2022

Related U.S. Application Data

(63) Continuation of application No. PCT/CN2020/109188, filed on Aug. 14, 2020.

(51) Int. Cl.
*A47L 9/14* (2006.01)
*A47L 9/28* (2006.01)

(52) U.S. Cl.
CPC ..... *A47L 9/149* (2013.01); *A47L 9/1409* (2013.01); *A47L 9/2873* (2013.01); *A47L 2201/024* (2013.01)

(58) Field of Classification Search
CPC ..... A47L 9/149; A47L 9/1409; A47L 9/2873; A47L 2201/024
See application file for complete search history.

(56) References Cited

U.S. PATENT DOCUMENTS 11,191,403 B2 * 12/2021 Gill ..... A47L 9/2873
2011/0191976 A1 8/2011 Yan
(Continued)

FOREIGN PATENT DOCUMENTS

CN 105708389 6/2016
CN 109419460 3/2019
(Continued)

OTHER PUBLICATIONS

Ivory—"How to Assembly Custom Plastic Injection Molded Components" (Year: 2014).*
StudioRed—"Injection Molded Part Design Part 3: Bosses" (Year: 2020).*
"International Application Serial No. PCT CN2020 109188, International Preliminary Report on Patentability dated Feb. 23, 2023", 5 pgs.
(Continued)

*Primary Examiner* — Marc Carlson
(74) *Attorney, Agent, or Firm* — Schwegman Lundberg & Woessner, P.A.

(57) ABSTRACT

A docking station for a mobile cleaning robot can include a canister and a base configured to receive the mobile cleaning robot thereon, where the base can include a front portion and a back portion opposite the front portion. The base can include a vacuum port extending at least partially through the base. The canister can be connected to the back portion of the base and can be located at least partially above the base. The canister can include a debris bin connected to the vacuum port to receive debris therefrom and a fan compartment connected to a side wall of the debris bin and including a fan system operable to draw debris through the vacuum port and the debris bin.

22 Claims, 10 Drawing Sheets

(56) References Cited

U.S. PATENT DOCUMENTS

| | | | | |
|---|---|---|---|---|
| 2016/0183752 | A1* | 6/2016 | Morin | A47L 9/2842 15/340.1 |
| 2016/0374528 | A1* | 12/2016 | Morin | A47L 9/19 15/319 |
| 2017/0196430 | A1* | 7/2017 | Machida | A47L 9/1683 |
| 2017/0273532 | A1* | 9/2017 | Machida | A47L 9/28 |
| 2019/0133399 | A1* | 5/2019 | Morin | A47L 9/19 |
| 2019/0328191 | A1* | 10/2019 | Tomasiak | A47L 7/0019 |
| 2020/0022543 | A1* | 1/2020 | Gill | A47L 9/102 |
| 2020/0069139 | A1* | 3/2020 | Johnson | G05D 1/0225 |
| 2021/0038034 | A1* | 2/2021 | Na | A47L 9/1436 |
| 2022/0015593 | A1* | 1/2022 | Conrad | A47L 9/165 |
| 2022/0061612 | A1* | 3/2022 | Wolff | A47L 9/1472 |
| 2022/0061614 | A1* | 3/2022 | Yu | A47L 9/1409 |

FOREIGN PATENT DOCUMENTS

| | | | | |
|---|---|---|---|---|
| CN | 109480713 | | 3/2019 | |
| CN | 111035326 | | 4/2020 | |
| CN | 112515531 | A * | 3/2021 | A47L 11/24 |
| CN | 111246786 | B * | 7/2022 | A47L 11/4025 |
| JP | 2017104334 | | 6/2017 | |
| JP | 2017104334 | A * | 6/2017 | |

OTHER PUBLICATIONS

"International Application Serial No. PCT CN2020 109188, International Search Report dated May 12, 2021", 5 pgs.
"International Application Serial No. PCT CN2020 109188, Written Opinion dated May 12, 2021", 4 pgs.

* cited by examiner

EVACUATION DOCK WITH FLUID MANAGEMENT

PRIORITY APPLICATIONS

This application claims the benefit of priority to International Patent Application Serial No. PCT/CN2020/109188, filed Aug. 14, 2020, the content of which is hereby incorporated by reference in its entirety.

BACKGROUND

Autonomous mobile robots include autonomous mobile cleaning robots that can autonomously perform cleaning tasks within an environment, such as a home. Many kinds of cleaning robots are autonomous to some degree and in different ways. Some robots can interface with a docking station automatically. The docking station can perform maintenance on the robot such as charging of batteries of the robot and evacuation of debris from a debris bin of the robot.

SUMMARY

Some autonomous cleaning robots can interface with a docking station for charging of the robot and for evacuation of a debris bin from the robot where debris can be draw from the debris bin of the robot, through the dock and into a container of the dock. In some examples, the docking station can include a replaceable bag configured to receive and retain the debris.

In some conditions, mobile cleaning robots can encounter water during a cleaning mission or operation. In some cases, the robots can ingest water or liquid into the debris bin while collecting debris from the environment. Then, during evacuation of the debris bin, this water can be evacuated from the debris bin of the mobile cleaning robot into the evacuation station or tower, as a fan or vacuum system pulls the fluid and debris from the mobile robot. In some cases, the transfer of fluid from the mobile cleaning robot to the evacuation station by the vacuum system can cause the fluid to be sprayed within the docking station. If the fluid that enters the docking station is not managed, it can contact electronics within the evacuation station or the mobile robot, which can cause electrical issues.

This disclosure helps to address these issues by including a side-by-side docking station where a fan system is positioned to the side or adjacent to a debris bin of a canister of the dock. Such placement can help reduce compromising the fan system due to water ingestion while also helping to reduce a height of the canister. This disclosure further helps to address these issues by including bosses having an extended height and configured to receive fasteners that are epoxied to the bosses, which can help limit fluid from escaping the canister and can help direct fluid to a weep hole or drain port of the canister for controlled discharge or drainage of the fluid. Additional features discussed below can help to mitigate or control fluid that enters the canister.

The above discussion is intended to provide an overview of subject matter of the present patent application. It is not intended to provide an exclusive or exhaustive explanation of the invention. The description below is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
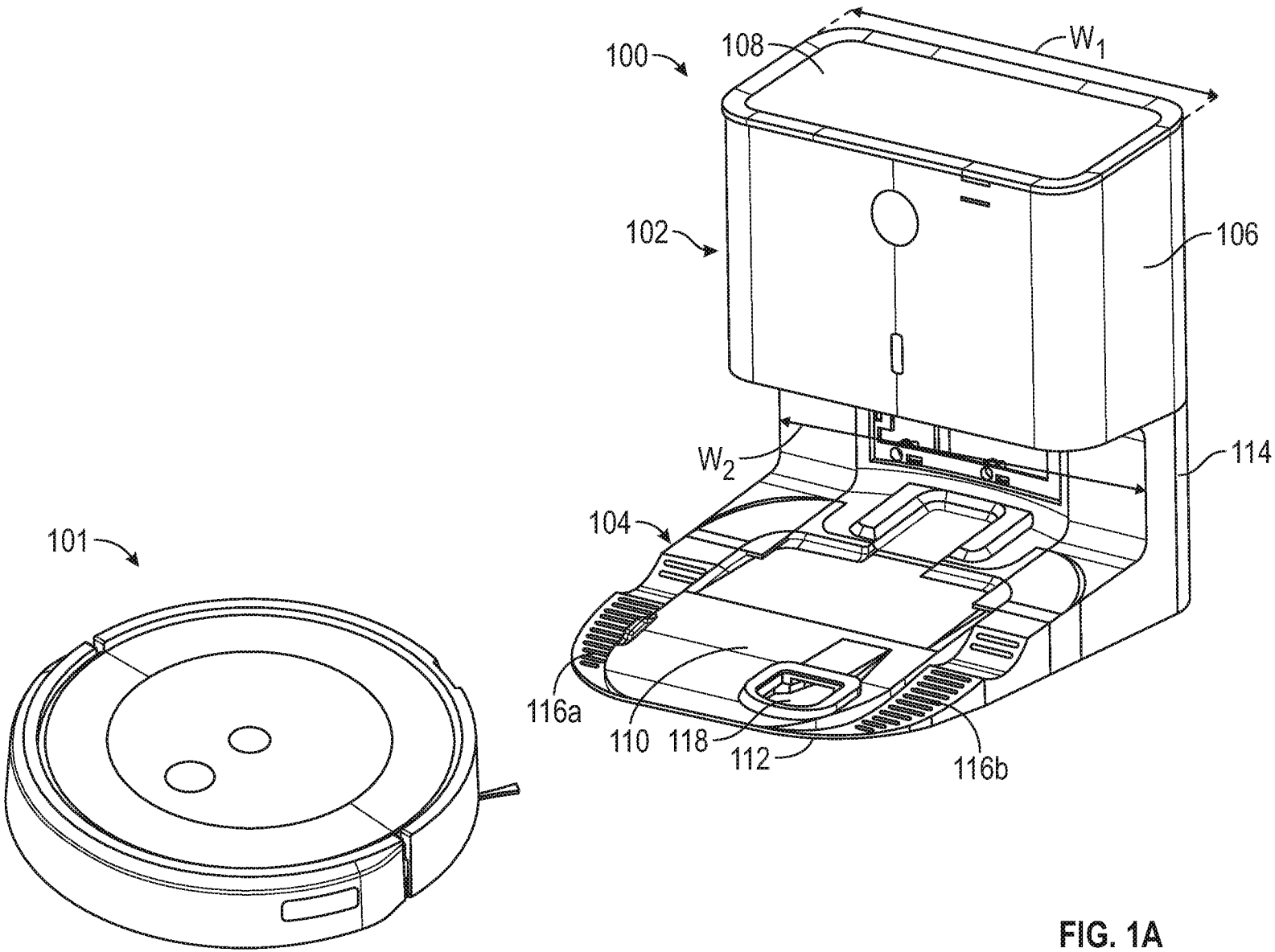
FIG. 1A illustrates an isometric view of a docking station for a mobile cleaning robot.
Figure 1B:
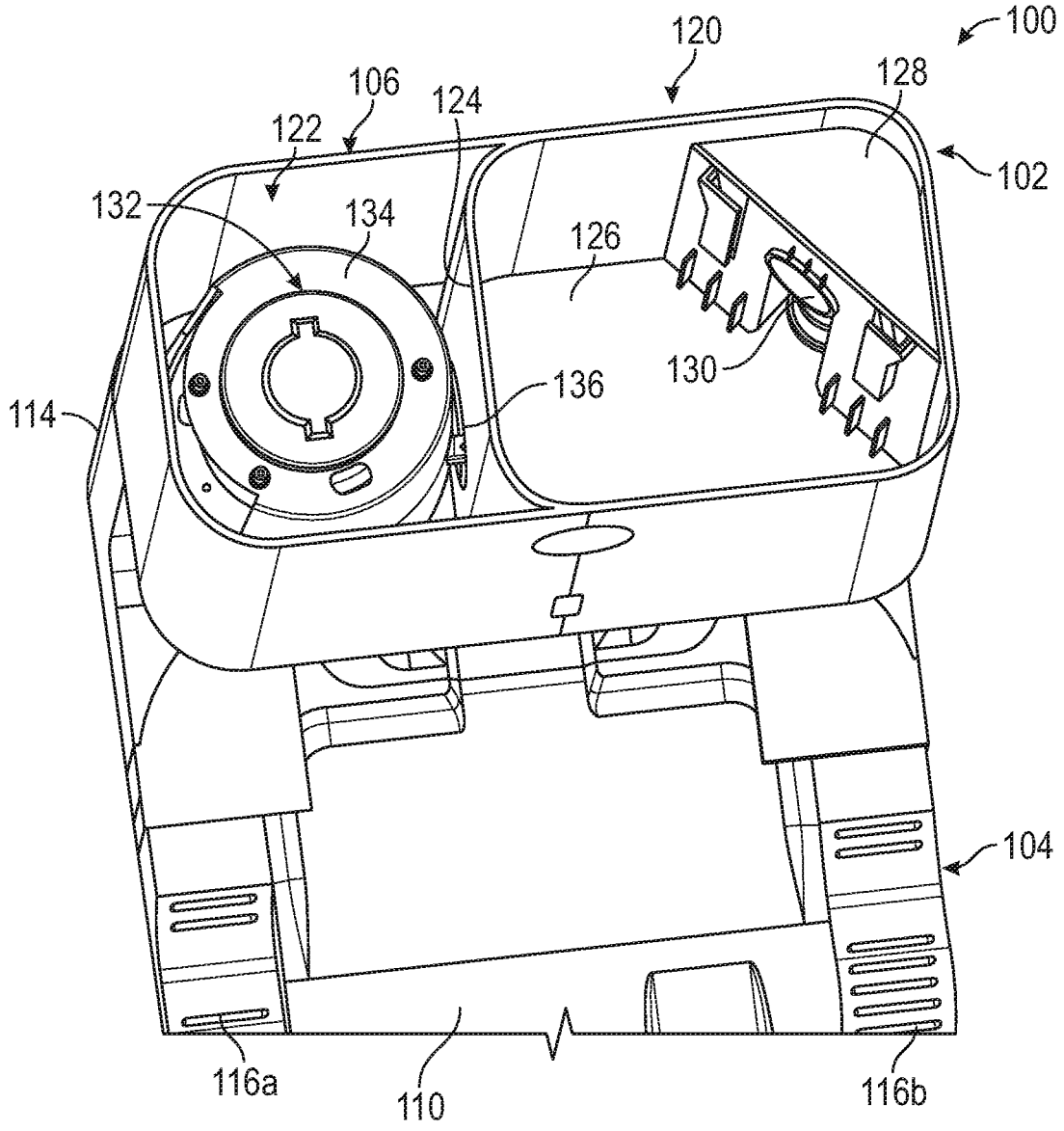
FIG. 1B illustrates a top isometric view of a portion of a docking station for a mobile cleaning robot.

FIG. 1A illustrates an isometric view of a docking station 100 for a mobile cleaning robot 101. FIG. 1B illustrates a top isometric view of a portion of the docking station 100. FIGS. 1A and 1B are discussed together below.

The docking station 100 can include a canister 102 and a base 104. The canister 102 can include an outer wall 106 and a lid 108 (as shown in FIG. 1A). The base 104 can include a platform 110 having a front portion 112 and a rear portion 114. The base can also include tracks 116*a* and 116*b* and a vacuum port 118. As shown in FIG. 1B, the canister 102 can include a debris bin 120, a fan compartment 122, and a side wall 124. The debris bin 120 can include a bottom wall 126 (or floor), a bag support 128, and a vacuum inlet 130. The canister 102 can also include a fan system 132 including a fan housing 134. FIG. 1A also shows widths w1 and w2 and orientation indicators Top, Bottom, Front, and Back.

The components of the docking station 100 can be rigid or semi-rigid components made of materials such as one or more of metals, plastics, foams, elastomers, ceramics, composites, combinations thereof, or the like. Materials of some components are discussed in further detail below. The mobile robot 101 can be a mobile cleaning robot including wheels, extractor, a debris bin, a controller, and various sensors. The robot 101 can be configured to perform autonomous cleaning missions or routines within an environment.

The base 104 can be a ramped member including the platform 110 and the tracks 116*a* and 116*b*, which can be configured to receive the mobile cleaning robot 101 thereon for maintenance, such as charging and emptying debris from the mobile cleaning robot. The tracks 116 can be configured to receive wheels of the robot 101 to guide the robot 101 onto the base 104 for charging and debris evacuation. The front portion 112 can be opposite the back portion 114, which can connect to the canister 102. The platform 110 and the tracks 116 can be sloped toward the front portion 112 to help allow the mobile robot 101 to dock on the station 100.

When the robot 101 is positioned on the base 104, such as when wheels of the robot 101 are in wheel wells of the tracks, the vacuum port 118 can be aligned with a vacuum outlet of the robot 101. The vacuum port 118 can extend through the base 104 and can connect to the vacuum inlet of the debris bin 120.

The canister 102 can be an upper portion of the docking station 100 connected to the rear portion 114 of the base 104 and can extend upward therefrom. The outer wall 106 of the canister 102 can have a shape of a substantially rectangular hollow prism with rounded corners where the outer wall 106 can define a top portion of the canister 102 that is open. The outer wall 106 can at least partially enclose the debris bin 120 and the fan compartment 122. A top portion of the canister 102 can have a width w1 that is about the same, or substantially the same, as a width w2 of the back portion 114 of the base 104, which can help to reduce a height of the docking station, which can allow the docking station to be positioned under furniture having a lower clearance.

The lid 108 can be connected to the outer wall 106 (such as by hinges or other fasteners), such as at a rear portion of the lid 108. The lid 108 can be releasably securable to the outer wall 106, such as at a front portion of the lid 108 and the outer wall 106 (such as via a friction/interference fit, latch, or the like). Removal of the lid 108 or opening of the lid 108 from the top portion of the canister 102 can provide access to both the fan compartment 122 and the debris bin 120.

The fan compartment 122 can be formed at least in part by the outer wall 106 and the side wall 124. The side wall 124 can be a substantially vertical wall extending between the floor 126 and the lid 108. The fan compartment 122 can be connected to the debris bin 120 by the side wall 124 such that the fan compartment 122 is adjacent to the debris bin 120 and such that the fan compartment 122 is offset from a central axis of the base 104 (as is the debris bin 120). The fan compartment 122 can support the fan system 132 therein, which can be pneumatically connected to the debris bin 120 via a fan port 136 extending through the side wall 124. That is, air can flow from the debris bin 120 through the fan port 136 and into the fan compartment 122, as motivated by the fan system 132. The fan system 132 can include the fan housing 134, which can contain the fan (such as an impeller and a motor of the fan system 132).

The bottom wall 126 (or floor) of the debris bin, the outer wall 106, and the side wall 124 can together define a volume of the debris bin 120. The lid 108 can also define the volume when the lid 108 is secured to the canister 102. The bag support 128 can be connected to the floor 126 and the outer wall 106 and can be configured to support a vacuum bag within the debris bin 120 where the bag can be pneumatically connected to the vacuum inlet 130 to connect the bag to the vacuum port 118 (and to the mobile robot 101 when the mobile robot 101 is in a docked position).

Figure 1C:
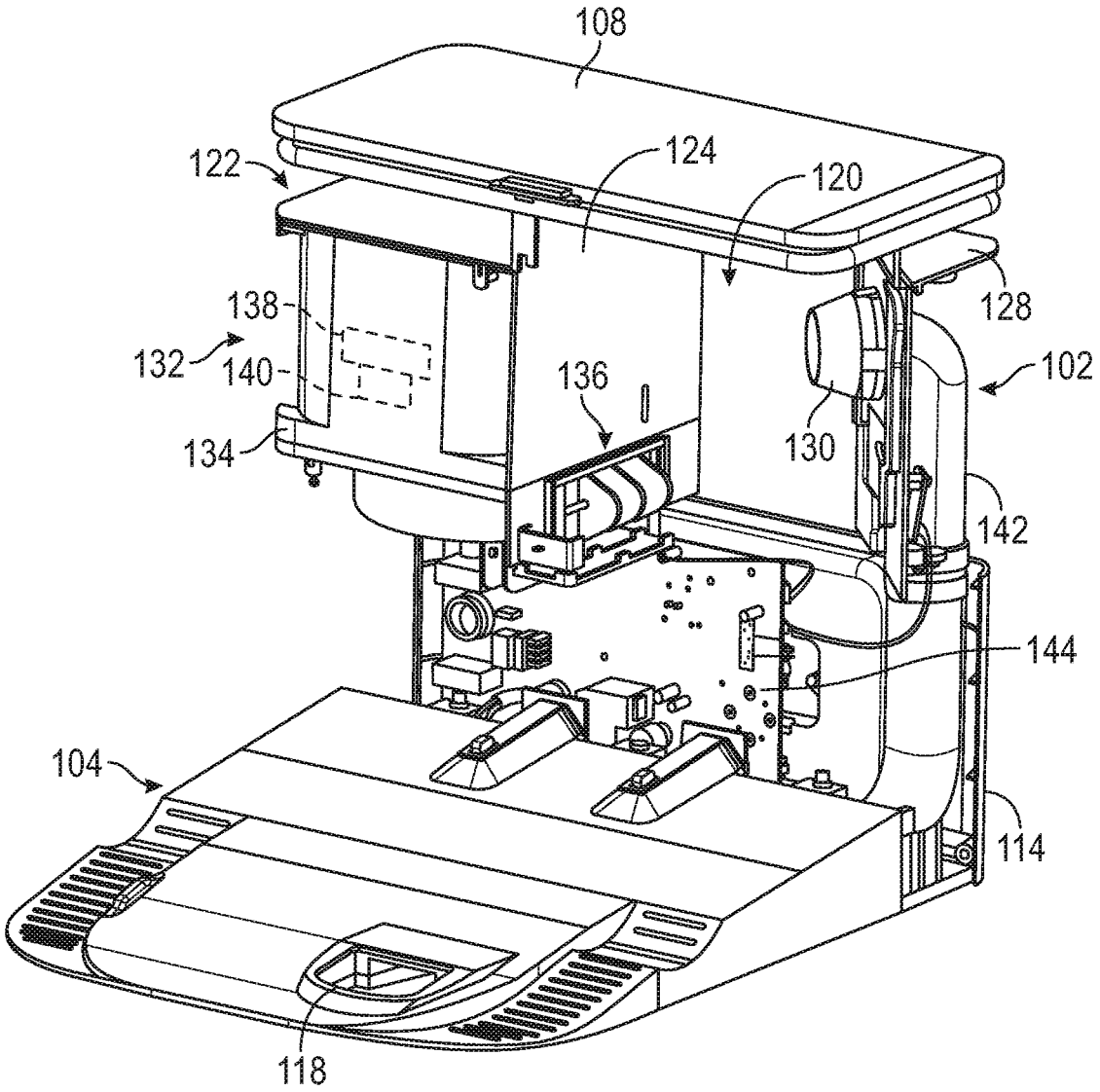
FIG. 1C illustrates a top isometric view of a portion of a docking station for a mobile cleaning robot.

FIG. 1C illustrates a top isometric view of a portion of the docking station 100 for the mobile cleaning robot 101. The docking station 100 can be consistent with the docking station 100 shown in FIGS. 1A and 1B; FIG. 1C shows the docking station 100 with a front panel of the base removed and the outer wall 106 of the canister 102 removed.

FIG. 1C shows that the fan system 132 can include an impeller 138 and a motor 140 within the fan housing 134. The motor 140 can be operable to motivate or drive the impeller 138 to move air such as from the inlet port 118 through a vacuum duct 142 of the base 104 and the canister 102 through the vacuum inlet 130 and into a bag in the debris bin 120. The air can then be drawn through the bag and through the fan port 136 and into the fan housing 134 and can be discharged or ejected through the outer wall 106.

FIG. 1C also shows a circuit board 144 that can be connected to the base 104, such as the rear portion 114 of the base 104. The circuit board 144 can connect to electrical components within the canister 102, such as a bag sensor, the motor 140, etc. Because the circuit board 144 is positioned below the canister 102 it is important to divert fluid or liquid (such as water) that enters the canister 102 away from the circuit board 144 and other sensitive electronics of the docking station 100 or the robot 101. Components and methods for controlling water or fluid entrainment are discussed in further detail below.

Figure 2:
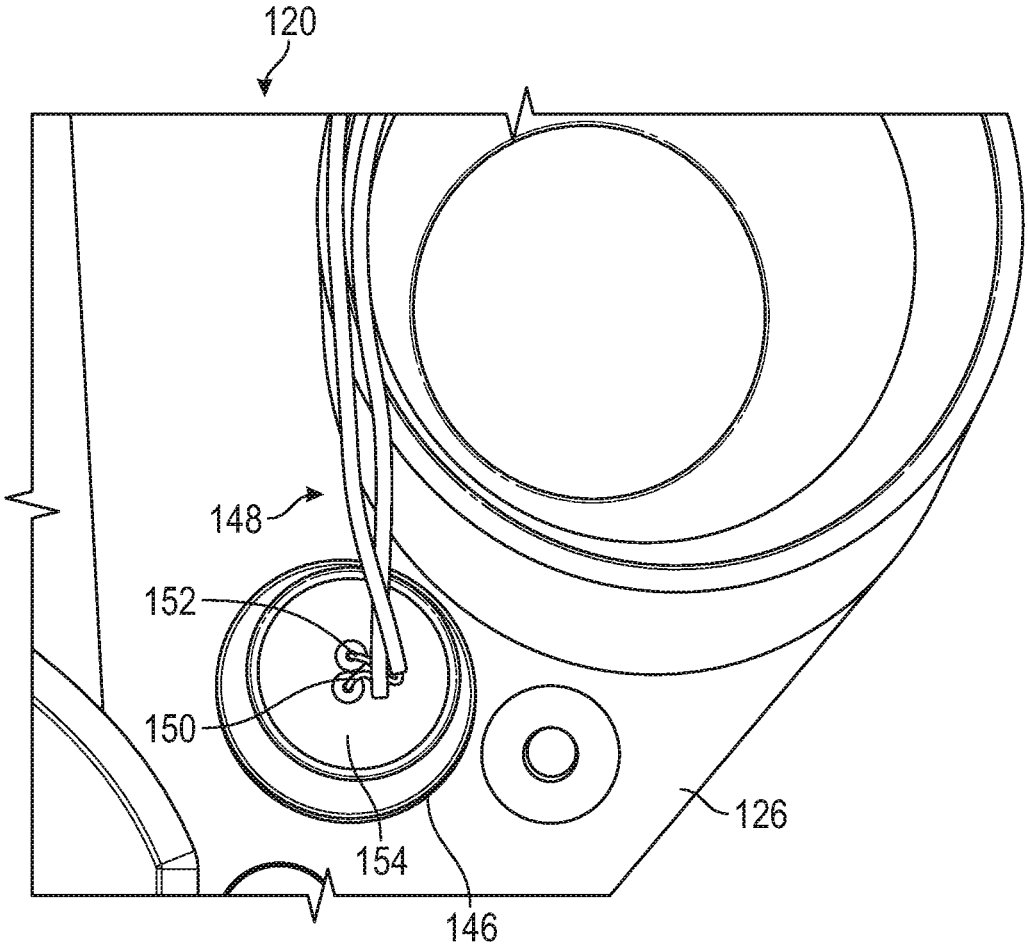
FIG. 2 illustrates a perspective view of a portion of a docking station for a mobile cleaning robot.

FIG. 2 illustrates a perspective view of a portion of the docking station 100. More specifically, FIG. 2 shows a portion of the floor 126 of the debris bin 120 where the floor 126 can include a bore 146 for receiving a wiring harness 148 therethrough. The wiring harness 148 can be connectable to a bag presence sensor, for example, and the circuit board 144 within the base 104, as shown in FIG. 1C. The wiring harness 148 can include leads 150 and 152 which can be conduits including wires.

FIG. 2 also shows a grommet 154, which can surround the leads 150 and 152 of the wiring harness 148 and can be positioned within the bore 146 to help seal the bore 156. The grommet 154 can be overmolded to the leads 150 and 152, which can form a seal between the leads 150 and 152 and the grommet 154. The grommet 154 can thereby help to seal the bore 146 to help limit water or fluid from escaping the canister 102, which can help to protect electrical components (such as the circuit board 144) from fluids and therefore from short circuiting. In some examples, the grommet 154 can be overmolded to a wiring harness of the fan motor 140 to seal a bore of the fan compartment.

Figure 3:
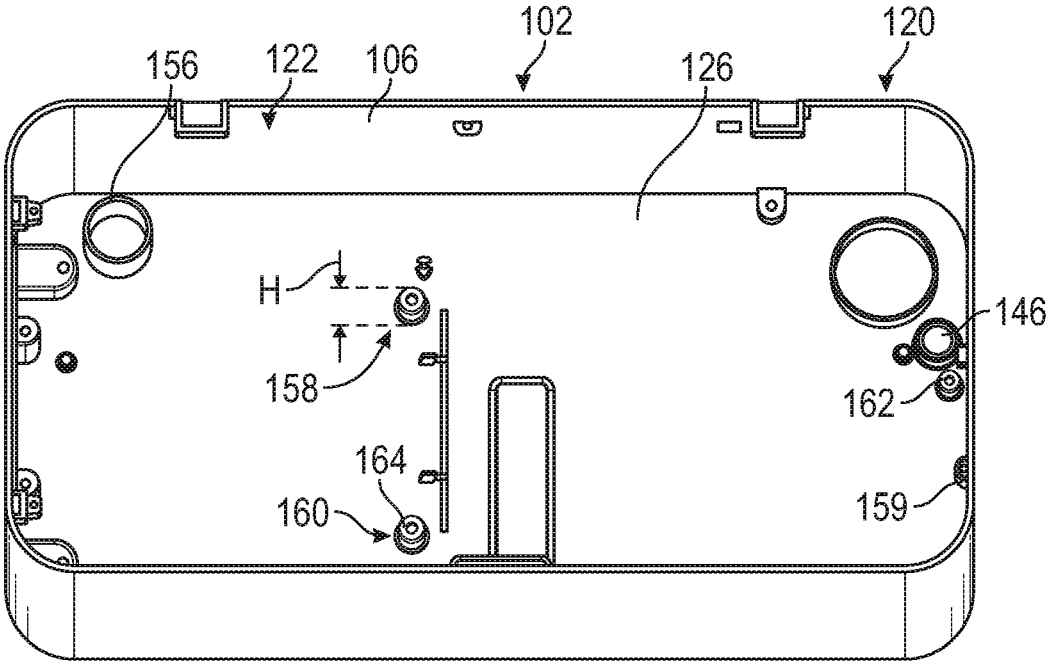
FIG. 3 illustrates a top perspective view of a portion of a docking station for a mobile cleaning robot.

FIG. 3 illustrates a top perspective view of the canister 102 of the docking station 100, which shows the debris bin 120 and the fan compartment 122 with the side wall and fan system removed. FIG. 3 also shows the bore 146 extending through the debris bin 120 and shows a fan harness bore 156 extending through the fan compartment 122. The grommet 154 can be used to seal the fan harness bore 156 and a wiring harness extending therethrough.

FIG. 3 also shows bosses 158, 160, and 162 along with other unnumbered bosses. Each boss can extend up from the floor 126 and can include a bore 164 extending through the boss (such as the boss 160) and the floor 126. The bore 164 of the boss 162 can be configured to receive a fastener to secure the debris bin 120 to the base 104. The bore 164 of the boss 160 can be configured to receive a fastener to secure the fan housing 134 to the boss 160 and optionally to the base 104.

Each boss can have a height H, as shown with respect to the boss 158. The bosses can have such a height to help contain water within the canister 102 and to help prevent liquid from escaping through the bores of the bosses, where the bosses can help allow time for the liquid or fluid to evacuate through a weep hole 159 or drain of the canister 102. In some examples, one or more of the bosses can have a height H between 10 millimeters and 15 millimeters. For example, the height H of each boss can be 10, 11, 12, 13, 14, 15, 16, or the like millimeters.

The weep hole 159 can be a small bore extending through the floor 126 or the outer wall 106 to connect a volume of the debris bin 120 (and optionally the fan compartment 122) with a surrounding environment. The weep hole 159 can be sized to allow fluid to drain without causing an impact on the pneumatic action of drawing debris from the robot (such as the robot 101) through the debris bin 120 using the fan system 132. In some examples, the weep hole 159 can have a diameter of between 2 millimeters and 4 millimeters, such as 3 millimeters. In some examples, the weep hole can include a fluid trap (such as a P-trap or J-trap) to help maintain vacuum pressure within the debris bin 120 during operation of the fan system 132. In some examples, more than one weep hole can be included in the canister 102.

Figure 4:
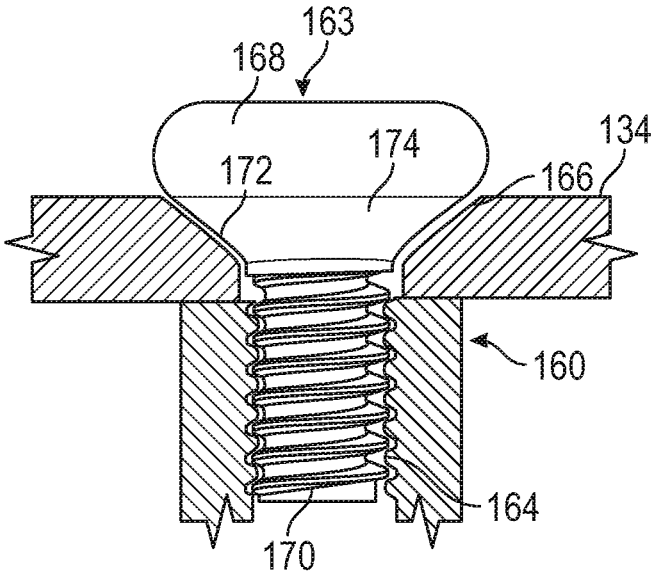
FIG. 4 illustrates a perspective view of a fastener for a docking station for a mobile cleaning robot.

FIG. 4 illustrates a perspective view of a fastener 163 (which can be a screw, nail, rivet, or the like) for a docking station for a mobile cleaning robot. FIG. 4 also shows the boss 160 and the fan housing 134 in a cross-sectional view. The fan housing 134 can include a bore 166 extending therethrough, which can be configured to receive a shank 170 of the fastener therethrough. The shank 170 of the fastener can be threadably secured the bore 164 of the boss (or to a nut or other female fastener) to secure the fan housing 134 to the boss 160 and therefore to the canister 102.

The fastener can include a head 168 connected to the shank 170 via a tapered portion 172. In some examples, a resin 174 can be applied to the head 168, such as to the tapered portion 172, and the resin 174 can be cured or polymerized to adhere to the tapered portion 172 and the fan housing 134 or the boss 160. This assembly can help to seal the bore 164 to help prevent liquid from escaping the debris bin 120 (and the canister 102), which can help protect electronic components of the base 104 and the robot 101.

The resin 174 can be any suitable resin, such as one or more resins chosen from an epoxy resin, an acrylic resin, an acrylate resin, a cyanoacrylate resin, cyano-urethane resin, a polysiloxane resin, a mixture thereof, or the like. The resin 174 can be cured using a thermal curing process, an ultra-violet light curing process, or the like.

Figure 5A:
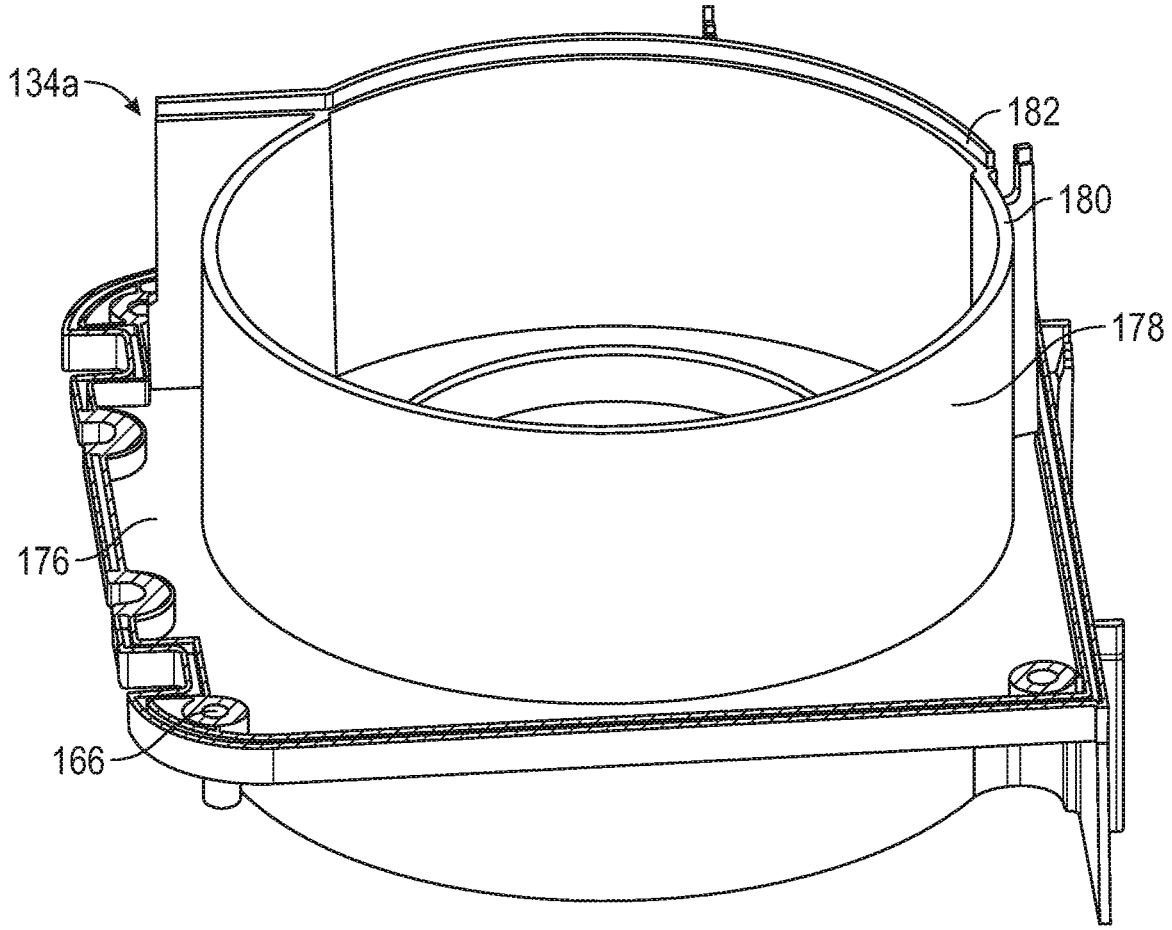
FIG. 5A illustrates an isometric of a portion of a fan housing for a docking station for a mobile cleaning robot.
Figure 5B:
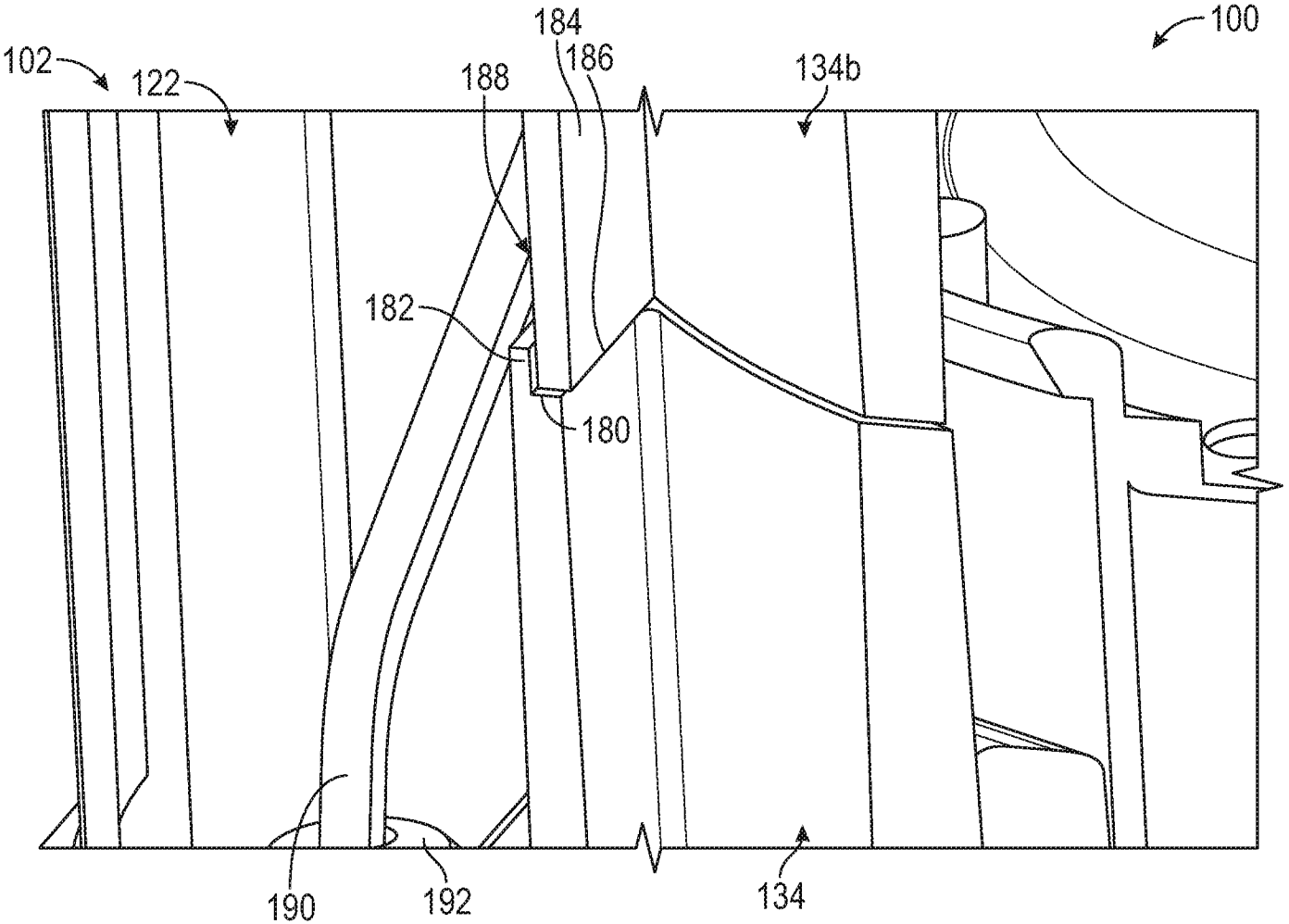
FIG. 5B illustrates an isometric of a portion of a fan housing for a docking station for a mobile cleaning robot.

FIG. 5A illustrates an isometric of a portion of the fan housing 134 for a docking station for a mobile cleaning robot. FIG. 5B illustrates an isometric of a portion of the fan housing 134 of the docking station 100 for a mobile cleaning robot. FIGS. 5A and 5B are discussed together below.

FIG. 5A shows a lower portion 134*a* of the fan housing 134, which can include a plate 176 including bosses 166 and a wall 178. The wall 178 can include a top portion including an outer lap portion 182.

The plate 176 can extend outward from the wall 178 and can be configured to secure the fan housing 134 to the canister 102, such as described with respect to FIGS. 3 and 4 above. The wall 178 can define at least a portion of a housing for the impeller 138 and the motor 140 of the fan system 132. The wall 178 can have a substantially cylindrical shape that can terminate at the top portion 180. The outer lap portion 182 can extend upward or vertically from a radially outer portion of the top portion 180 of the wall 178 to at least partially surround a portion of the upper portion 134*b* and to form at least a part of the lap seal or lap joint 188 with the upper portion 134*b* of the fan housing 134, as shown in FIG. 5B.

That is, FIG. 5B shows how the top portion 180 can receive a bottom portion 186 of a wall 184 of the upper portion 134*b* of the fan housing 134. FIG. 5B also shows how the lap portion 182 can extend radially beyond the wall 184 of the upper portion 134*b* of the fan housing 134 and shows how the lap portion 182 can extend axially beyond the bottom portion 186 of the wall 184 of the upper portion 134*b*. This arrangement can form the lap seal (or lap joint) 188 between the lower portion 134*a* and the upper portion 134*b* of the fan housing 134, which can help limit liquid from entering the fan housing 134. Though FIGS. 5A and 5B show the lap as extending from the lower portion 134*a*, the upper portion 134*b* can include a lapping portion.

FIG. 5B also shows a wiring harness 190 of the fan system 132, which can extend through the canister 102 through a grommet 192, which can be similar to the grommet 154 discussed above with respect to FIG. 3. Such a grommet 192 can help prevent liquid from escaping the canister 102 into the base 104 of the docking station 100.

Figure 6B:
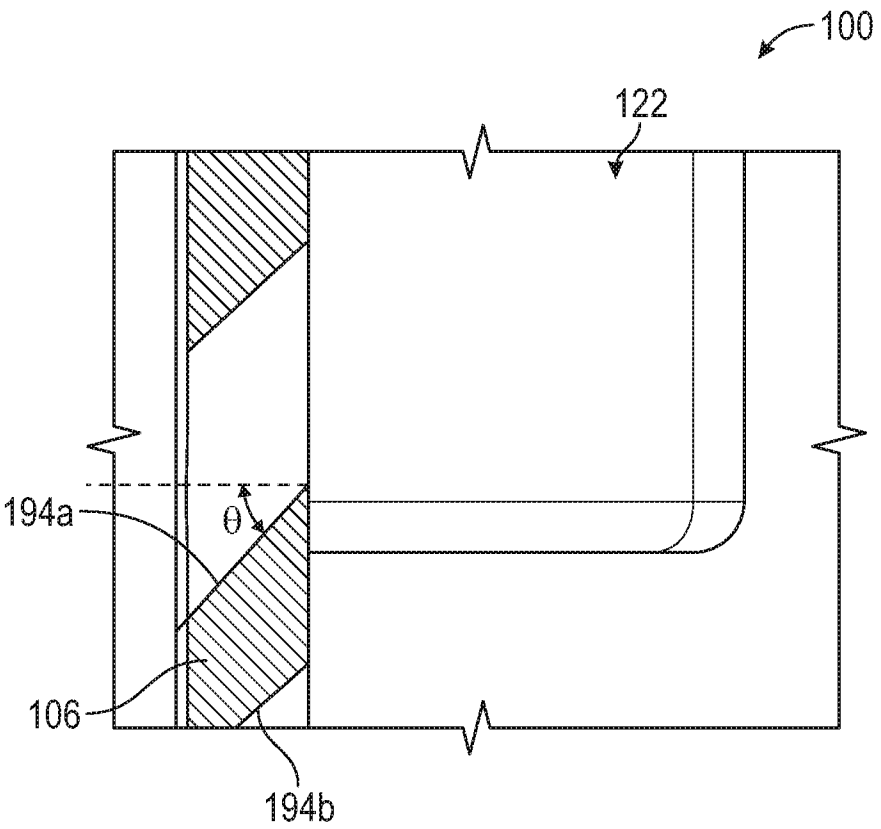
FIG. 6B illustrates a cross-sectional view of a portion of a docking station for a mobile cleaning robot.
Figure 6A:
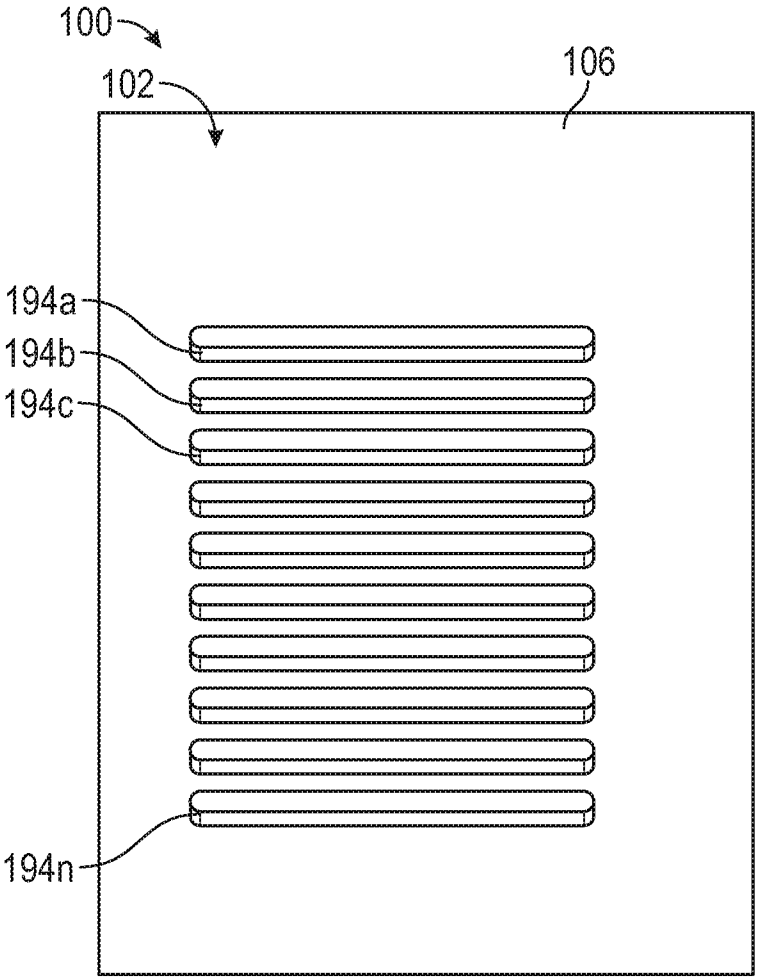
FIG. 6A illustrates a perspective view of a portion of a docking station for a mobile cleaning robot.

FIG. 6A illustrates a perspective view of a portion of the docking station 100 for a mobile cleaning robot. FIG. 6B illustrates a cross-sectional view of the portion of a docking station 100 for a mobile cleaning robot. FIGS. 6A and 6B are discussed together below. The docking station 100 of FIGS. 6A and 6B can be consistent with the docking station 100 discussed above; FIGS. 6A and 6B show additional details of the docking station. For example, FIGS. 6A and 6B show discharge openings 194*a*-194*n* through the outer wall 106 of the fan compartment 122.

The discharge openings 194*a*-194*n* can extend through the outer wall 106 and can be spaced apart from each other. The discharge openings 194*a*-194*n* can be positioned near the fan system 132 and can be configured to discharge air from the fan system 132 to a surrounding environment (such as a room in a house). The discharge openings 194*a*-194*n* can be slots as shown in FIG. 6A, but can be channels, bores, or the like.

As shown in FIG. 6B, the discharge openings 194*a*-194*n* can be angled downward, such as at an angle θ. The angle θ can be between 10 degrees and 80 degrees downward from a horizontal plane. The angle θ can be between 35 degrees and 55 degrees in some examples. The angle θ can be about 45 degrees in some examples.

During evacuation operations of the robot, fluid can be drawn from the bin of the mobile robot through the debris bin 120 by the fan system 132, as discussed in detail above. The fluid can be discharge from the fan housing 134 by the impeller 138 and can ultimately be discharged through from the fan compartment 122 through the outer wall 106 by traveling through the discharge openings 194*a*-194*n*. Because the discharge openings 194*a*-194*n* are angled downward, the discharge openings 194*a*-194*n* can help to direct air and fluid towards a floor of the environment. This can help to limit fluid spray on surrounding walls or other items in the environment.

Figure 7A:
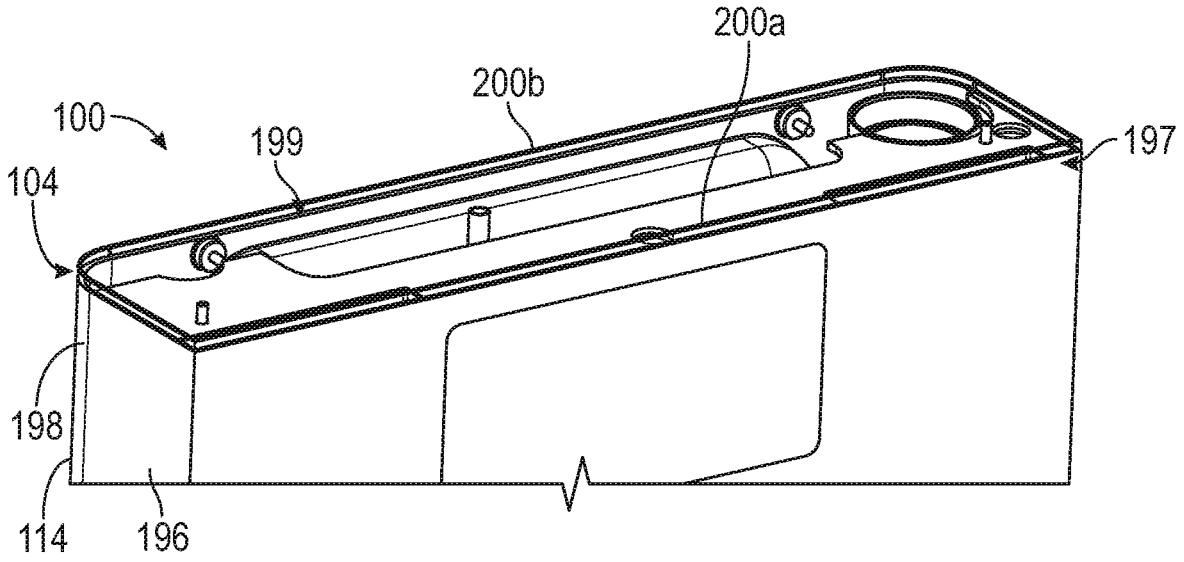
FIG. 7A illustrates an isometric view of a portion of a docking station for a mobile cleaning robot.
Figure 7B:
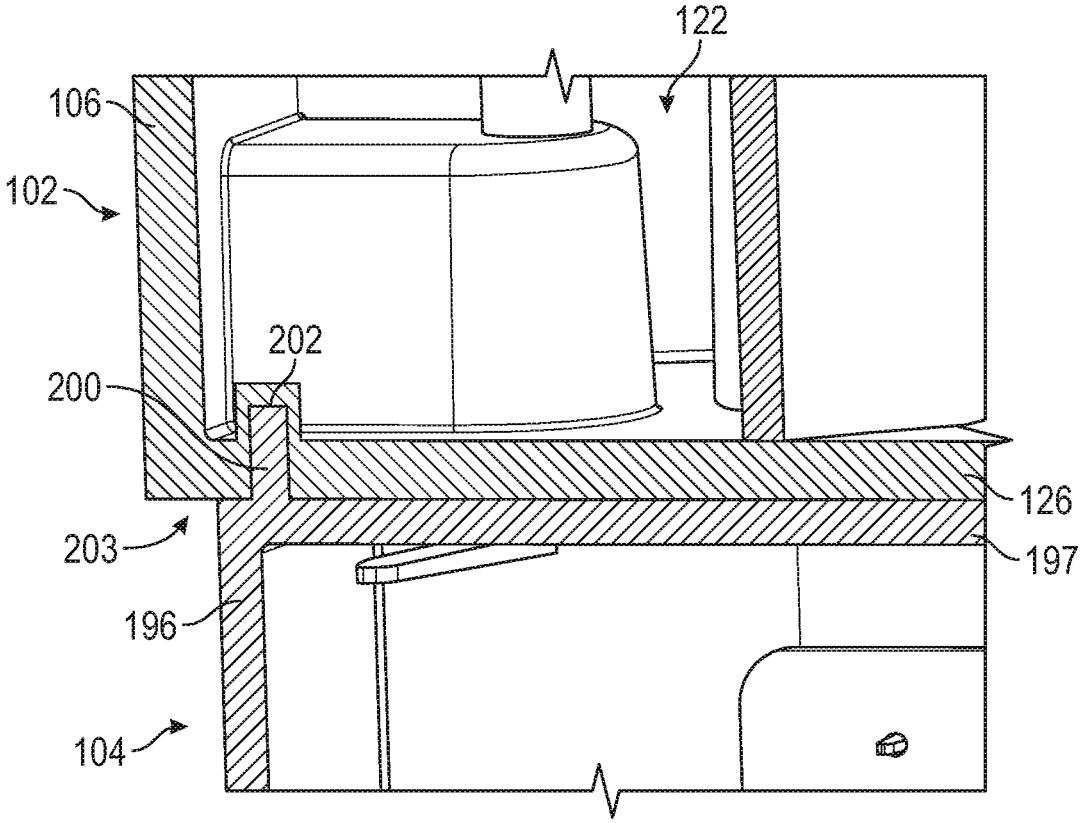
FIG. 7B illustrates a cross-sectional view of a portion of a docking station for a mobile cleaning robot.

FIG. 7A illustrates an isometric view of the base 104 of the docking station 100 for a mobile cleaning robot. FIG. 7B illustrates a cross-sectional view of the base 104 and the canister 102 of the docking station 100 for a mobile cleaning robot. FIGS. 7A and 7B are discussed together below.

The docking station 100 of FIGS. 7A and 7B can be consistent with the docking station 100 discussed above; FIGS. 7A and 7B show additional details of the docking station 100. For example, FIG. 7A shows that the base 104 can include a front panel 196 (including a top portion 197) connected to the back portion 114 and extending upward from the platform 110 and shows that the base 104 can include a back panel 198 (including a top portion 199) connected to the back portion 114 and extending upward from the platform 110. The front panel 196 and the back panel 198 can be connected to each other such that the top portions 197 and 199 can align or can be planar.

The front panel 196 can include a lip or projection 200*a* extending from the top portion 197. Similarly, the back or rear panel 198 can include a lip or projection 200*b* extending from the top portion 199. The lips 200*a* and 200*b* can be in alignment where they meet to form a substantially continuous lip around the top portions 197 and 199 of the panels 196 and 198. In some examples, the lips 200 can be on an inner portion of the top portions 197 and 199.

As shown in FIG. 7B, the floor 126 of the canister 102 can include a recess 202 extending upward from the floor 126. The recess 202 can be positioned inside the outer wall 106. The recess 202 can extend around at least a portion of a periphery of a bottom portion of the canister. The recess 202 can be sized and shaped to receive the lip 200 of the top portions 197 and 199 to form a lap joint 203 between the canister 102 and the base 104. That is, the front lip 200*a* can be inserted at least partially within the recess 202 and the back lip 200*b* can be inserted at least partially into the recess 202 to form the lap joint 203.

The canister 102 can extend outward of the front panel 196 and the back panel 198, as shown in FIG. 7B. By extending outward of the panels and forming the lap joint 203, the panels 196 and 198 and the canister 102 can help prevent water or liquid from entering the base 104 during intake of liquid from the robot or discharge of liquid from the fan system 132.

Figure 8A:
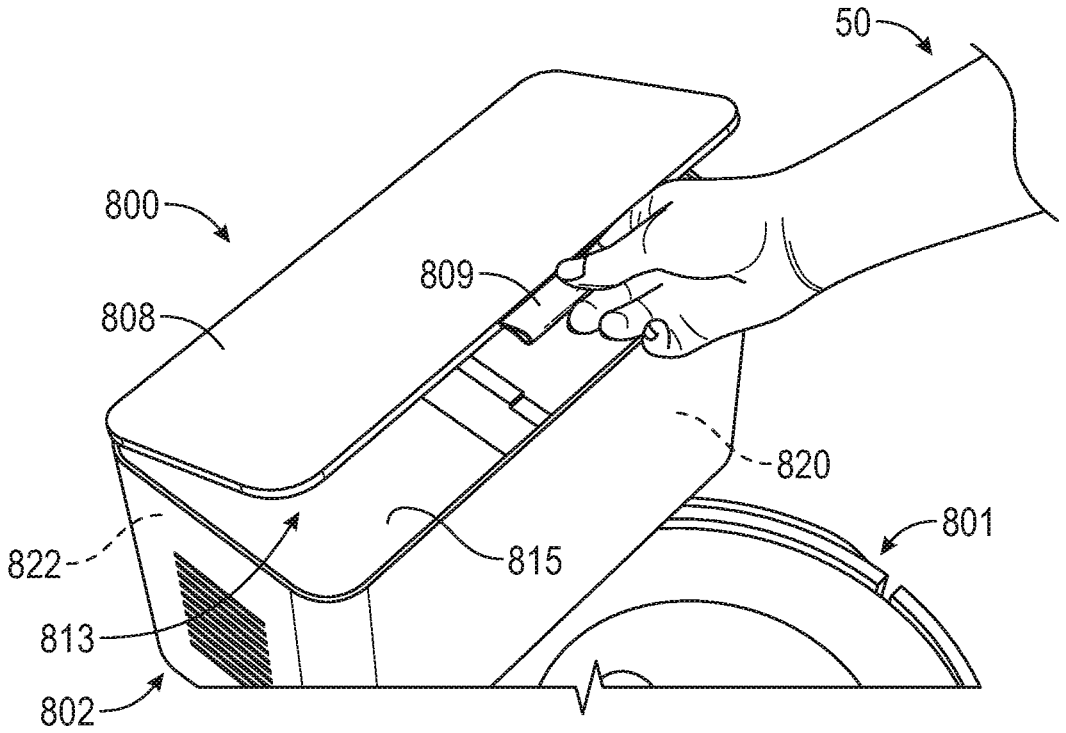
FIG. 8A illustrates an isometric view of a portion of a docking station for a mobile cleaning robot.
Figure 8B:
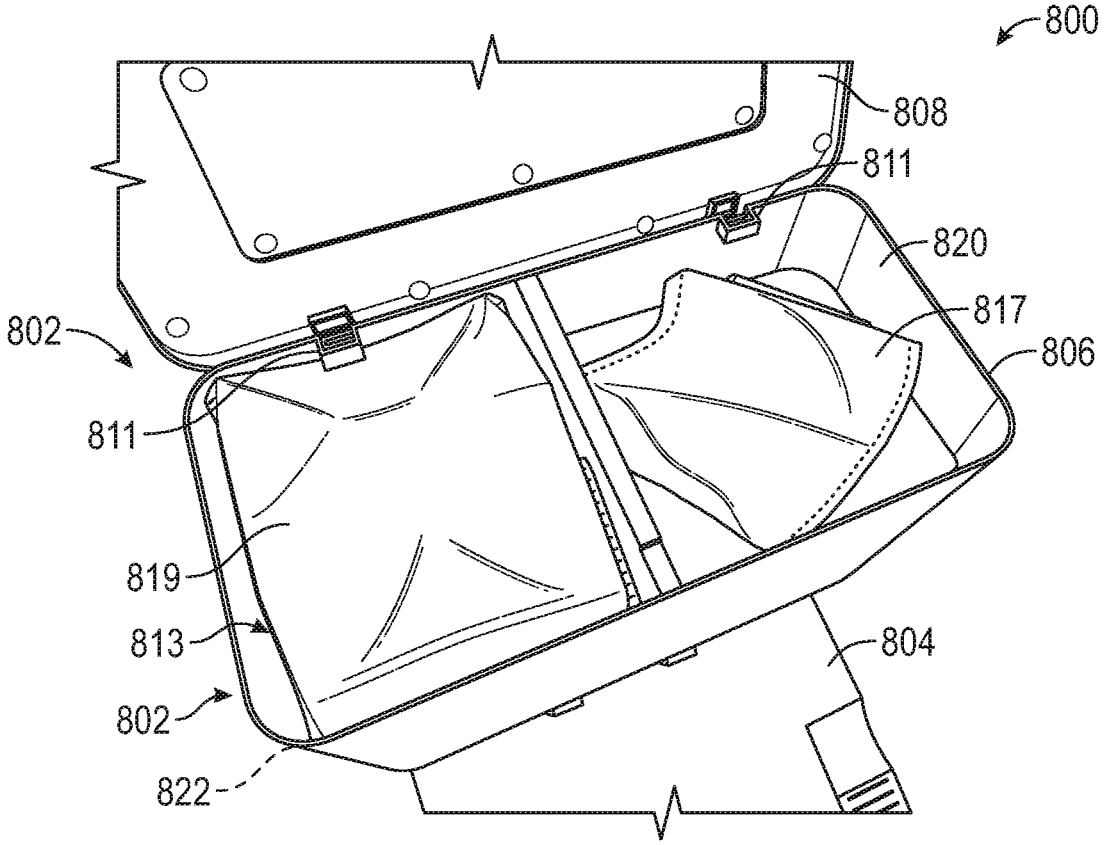
FIG. 8B illustrates an isometric view of a portion of a docking station for a mobile cleaning robot.

FIG. 8A illustrates an isometric view of a portion of a docking station 800 for a mobile cleaning robot. FIG. 8B illustrates an isometric view of a portion of the docking station 800 for a mobile cleaning robot. FIGS. 8A and 8B are discussed together below. The docking station 800 can include a compartment for storing one or more bag refills or spare bags. Any of the previously discussed docking stations can be modified to include such a compartment.

FIG. 8A shows the docking station 800 and a mobile cleaning robot 801 where a user 50 is operating a tab 809 of a lid 808 of a canister 802 of the docking station 800. As shown in FIG. 8B, the lid 808 can be attached to the outer wall 806 of the canister 802 by hinges, which can allow the lid 808 to pivot or rotate upward when the user 50 operates (lifts the tab 809). As shown in FIG. 8A, opening the lid 808 can expose the debris bin 820 and the fan compartment 822. FIG. 8B shows that a vacuum bag 817 can be connected to the vacuum system (such as to the inlet 130) within the debris bin 820.

The fan compartment 822 can be covered by a storage compartment 813. The storage compartment 813 can include a wall 815 at a bottom portion of the storage compartment 813 that can cover or substantially cover a fan system (such as the fan system 132) located within the fan compartment 822. The storage compartment can be configured to store one or more spare bags 819 therein. When the user 50 removes the vacuum bag 817 (such as when the bag 817 is full or in need of replacement), the user 50 can retrieve the spare bag 819 from the storage compartment 813 and install it within the debris bin 820 before shutting the lid. The 813 compartment can thereby reduce a time required to replace the bag 817.

Notes and Examples

The following, non-limiting examples, detail certain aspects of the present subject matter to solve the challenges and provide the benefits discussed herein, among others.

Example 1 is a docking station for a mobile cleaning robot, the docking station comprising: a base configured to receive the mobile cleaning robot thereon, the base including a front portion and a back portion opposite the front portion; a vacuum port extending at least partially through the base; and a canister connected to the back portion of the base and located at least partially above the base, the canister comprising: a debris bin connected to the vacuum port to receive debris therefrom, the debris bin including a side wall and a floor connected to the side wall, the side wall and the floor together at least partially enclosing the debris bin; and a fan compartment connected to the side wall of the debris bin and including a fan system operable to draw debris through the vacuum port and the debris bin.

In Example 2, the subject matter of Example 1 optionally includes wherein the fan compartment includes a plurality of discharge openings extending downward through the fan compartment and configured to discharge air from the fan system in a downward direction.

In Example 3, the subject matter of Example 2 optionally includes wherein the plurality of discharge openings are angled downward between 35 and 55 degrees.

In Example 4, the subject matter of any one or more of Examples 1-3 optionally include wherein the fan base includes a front panel connected to and extending upward from the back portion of the base and includes a back panel connected to the back portion and connected to the front panel, the back panel extending upward from the back portion of the base, and wherein the canister is connected to the back panel and the front panel at least in part by a lap joint.

In Example 5, the subject matter of Example 4 optionally includes wherein the canister includes a recess extending around at least a portion of a periphery of a bottom portion of the canister.

In Example 6, the subject matter of Example 5 optionally includes wherein the front panel includes a front lip extending around at least a portion of a periphery of a top portion of the front panel, wherein the back panel includes a back lip extending around at least a portion of a periphery of a top portion of the back panel, and wherein the lap joint is formed at least in part by the front lip, the back lip, and the recess.

In Example 7, the subject matter of any one or more of Examples 1-6 optionally include wherein the debris bin includes a boss extending up from the floor, the boss including a bore extending through the boss and the floor, the bore configured to receive a fastener to secure the debris bin to the base.

In Example 8, the subject matter of Example 7 optionally includes wherein the fastener is secured to the boss using a resin.

In Example 9, the subject matter of Example 8 optionally includes wherein the fastener is a screw and the resin is cured or polymerized using ultraviolet light.

In Example 10, the subject matter of Example 9 optionally includes wherein the boss has a height between 10 millimeters and 15 millimeters.

In Example 11, the subject matter of any one or more of Examples 1-10 optionally include wherein a top portion of the canister has a width that is substantially the same as a width of the back portion of the base.

In Example 12, the subject matter of any one or more of Examples 1-11 optionally include wherein removal of a lid from a top of the canister provides access to both the fan compartment and the debris bin.

In Example 13, the subject matter of Example 12 optionally includes wherein the side wall is a vertical wall that separates the fan compartment and the debris bin.

In Example 14, the subject matter of any one or more of Examples 12-13 optionally include wherein the fan compartment is offset from a central axis of the base.

In Example 15, the subject matter of any one or more of Examples 1-14 optionally include a fan compartment wall located in the fan compartment and above the fan system, the fan compartment wall configured to receive a spare vacuum bag and store the spare vacuum bag between the fan compartment wall and a lid connected to the top of the canister when the lid is closed.

Example 16 is a docking station for a mobile cleaning robot, the docking station comprising: a base configured to receive the mobile cleaning robot thereon, the base including a front portion and a back portion opposite the front portion; a vacuum port extending at least partially through the base; a debris bin connected to the back portion of the base and connected to the vacuum port to received debris therefrom, the debris bin comprising: a side wall and a floor connected to the side wall, the side wall and the floor together at least partially enclosing the debris bin; and a boss extending up from the floor, the boss including a bore extending through the boss and the floor, the bore configured to receive a fastener to secure the debris bin to the base; a fan compartment connected to the back portion of the base and connected to the side wall of the debris bin; and a fan system located within the fan compartment, the fan system operable to draw debris from the vacuum port through the debris bin.

In Example 17, the subject matter of Example 16 optionally includes wherein the fastener is secured to the boss using a resin.

In Example 18, the subject matter of Example 17 optionally includes wherein the fastener is a screw and the resin is cured or polymerized using ultraviolet light.

In Example 19, the subject matter of Example 18 optionally includes wherein the boss has a height between 10 millimeters and 15 millimeters.

In Example 20, the subject matter of Example 19 optionally includes wherein debris bin includes a plurality of bosses including the boss, each of the plurality of bosses extending up from the floor.

In Example 21, the subject matter of any one or more of Examples 16-20 optionally include a bin wiring harness extending through a bin bore of the side wall; and a bin grommet overmolded to the bin wiring harness and located within the bin bore to at least partially seal the bin bore.

In Example 22, the subject matter of Example 21 optionally includes a fan wiring harness extending through a compartment bore of the fan compartment; and a fan grommet overmolded to the fan wiring harness and located within the compartment bore to at least partially seal the compartment bore.

In Example 23, the subject matter of any one or more of Examples 16-22 optionally include a weep hole extending through one or more of the side wall and the floor, the weep hole connecting a volume of the bin to a surrounding environment.

In Example 24, the subject matter of Example 23 optionally includes wherein the weep hole has a diameter between 2 millimeters and 4 millimeters.

Example 25 is a docking station for a mobile cleaning robot, the docking station comprising: a base configured to receive the mobile cleaning robot thereon, the base including a front portion and a back portion opposite the front portion; a vacuum port extending at least partially through the base; a debris bin connected to the back portion of the base and connected to the vacuum port to received debris therefrom, the debris bin including a debris bin compartment at least partially enclosing the debris bin; a fan compartment connected to the back portion of the base and connected to the debris bin; and a fan system located within the fan compartment, the fan system comprising: a fan assembly operable to draw debris from the vacuum port through the debris bin; and a fan housing containing the fan assembly, the fan housing comprising: a first portion; and a second portion connected to the first portion by a lap joint.

In Example 26, the subject matter of Example 25 optionally includes wherein the first portion is an upper portion of the fan housing and wherein the second portion is a lower portion of the fan housing.

In Example 27, the subject matter of Example 26 optionally includes wherein the lower portion forms an outer portion of the lap joint.

In Example 28, the subject matter of Example 27 optionally includes wherein the outer portion of the lap joint extends vertically to at least partially surround a portion of the upper portion of the fan housing.

In Example 29, the subject matter of any one or more of Examples 25-28 optionally include wherein the fan assembly includes an impeller and a motor operable to drive the impeller.

In Example 30, the subject matter of any one or more of Examples 25-29 optionally include wherein the fan housing includes a plurality of discharge openings extending downward through the fan housing configured to discharge air from the fan assembly in a downward direction.

In Example 31, the subject matter of Example 30 optionally includes degrees wherein the plurality of discharge openings are angled downward between 35 and 55 degrees.

Example 32 is a docking station for a mobile cleaning robot, the docking station comprising: a base configured to receive the mobile cleaning robot thereon, the base comprising: a front portion and a back portion opposite the front portion; a front panel connected to the back portion and extending upward from the back portion; and a back panel connected to the back portion and connected to the front panel, the back panel extending upward from the back portion; a vacuum port extending at least partially through the base; and a canister connected to the back panel and the front panel at least in part by a lap joint, the canister comprising: a debris bin connected to the vacuum port to received debris therefrom; and a fan compartment connected to the debris bin and including a fan system therein.

In Example 33, the subject matter of Example 32 optionally includes wherein the canister includes a recess extending around at least a portion of a periphery of a bottom portion of the canister.

In Example 34, the subject matter of Example 33 optionally includes wherein the front panel includes a front lip extending around at least a portion of a periphery of a top portion of the front panel, and the back panel includes a back lip extending around at least a portion of a periphery of a top portion of the back panel, and wherein the lap joint is formed at least in part by the front lip, the back lip, and the recess.

In Example 35, the subject matter of Example 34 optionally includes wherein the front lip is inserted at least partially within the recess and the back lip is inserted at least partially into the recess to form the lap joint.

In Example 36, the subject matter of any one or more of Examples 32-35 optionally include wherein the lap joint extends around an entirety of a periphery of the canister.

In Example 37, the apparatuses or method of any one or any combination of Examples 1-36 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A docking station for a mobile cleaning robot, the docking station comprising:

a base configured to receive the mobile cleaning robot thereon, the base including a front portion and a back portion opposite the front portion;

a vacuum port extending at least partially through the base;

a canister connected to the back portion of the base and located at least partially above the base, the canister comprising:

a debris bin connected to the vacuum port to receive debris therefrom, the debris bin including a side wall and a floor connected to the side wall, the side wall and the floor together at least partially enclosing the debris bin; and a fan compartment connected to the side wall of the debris bin and including a fan system operable to draw debris through the vacuum port and the debris bin, the fan compartment including a plurality of discharge openings extending at least partially downward through an outer wall of the fan compartment and configured to discharge air from the fan system at least partially in a downward direction; and a fan compartment wall located in the fan compartment and above the fan system, the fan compartment wall configured to receive a spare vacuum bag and store the spare vacuum bag between the fan compartment wall and a lid connected to a top of the canister when the lid is closed.

2. The docking station of claim 1, wherein the plurality of discharge openings are angled downward between 35 and 55 degrees.

3. The docking station of claim 1, wherein the base includes a front panel connected to and extending upward from the back portion of the base and includes a back panel connected to the back portion and connected to the front panel, the back panel extending upward from the back portion of the base, and wherein the canister is connected to the back panel and the front panel at least in part by a lap joint.

4. The docking station of claim 3, wherein the canister includes a recess extending around at least a portion of a periphery of a bottom portion of the canister.

5. The docking station of claim 4, wherein the front panel includes a front lip extending around at least a portion of a periphery of a top portion of the front panel, wherein the back panel includes a back lip extending around at least a portion of a periphery of a top portion of the back panel, and wherein the lap joint is formed at least in part by the front lip, the back lip, and the recess.

6. The docking station of claim 1, wherein the debris bin includes a boss extending up from the floor, the boss including a bore extending through the boss and the floor, the bore configured to receive a fastener to secure the debris bin to the base.

7. The docking station of claim 6, wherein the fastener is secured to the boss using a resin.

8. The docking station of claim 7, wherein the fastener is a screw and the resin is cured or polymerized using ultraviolet light.

9. The docking station of claim 8, wherein the boss has a height between 10 millimeters and 15 millimeters.

10. The docking station of claim 1, wherein a top portion of the canister has a width that is substantially the same as a width of the back portion of the base.

11. The docking station of claim 1, wherein removal of a lid from a top of the canister provides access to both the fan compartment and the debris bin.

12. The docking station of claim 11, wherein the side wall is a vertical wall that separates the fan compartment and the debris bin.

13. The docking station of claim 11, wherein the fan compartment is offset from a central axis of the base.

14. A docking station for a mobile cleaning robot, the docking station comprising:

a base configured to receive the mobile cleaning robot thereon, the base including a front portion and a back portion opposite the front portion;

a vacuum port extending at least partially through the base; and a canister connected to the back portion of the base and located at least partially above the base, the canister comprising:

a debris bin connected to the vacuum port to receive debris therefrom, the debris bin including a side wall and a floor connected to the side wall, the side wall and the floor together at least partially enclosing the debris bin;

a fan compartment connected to the side wall of the debris bin and including a fan system operable to draw debris through the vacuum port and the debris bin, the fan compartment including a plurality of discharge openings extending at least partially downward through an outer wall of the fan compartment and configured to discharge air from the fan system at least partially in a downward direction; and a lid removable from a top portion of the canister to provide access to both the fan compartment and the debris bin.

15. The docking station of claim 14, wherein the plurality of discharge openings are angled downward between 35 and 55 degrees.

16. The docking station of claim 14, wherein the base includes a front panel connected to and extending upward from the back portion of the base and includes a back panel connected to the back portion and connected to the front panel, the back panel extending upward from the back portion of the base, and wherein the canister is connected to the back panel and the front panel at least in part by a lap joint.

17. The docking station of claim 16, wherein the canister includes a recess extending around at least a portion of a periphery of a bottom portion of the canister.

18. The docking station of claim 17, wherein the front panel includes a front lip extending around at least a portion of a periphery of a top portion of the front panel, wherein the back panel includes a back lip extending around at least a portion of a periphery of a top portion of the back panel, and wherein the lap joint is formed at least in part by the front lip, the back lip, and the recess.

19. The docking station of claim 14, wherein the debris bin includes a boss extending up from the floor, the boss including a bore extending through the boss and the floor, the bore configured to receive a fastener to secure the debris bin to the base.

20. The docking station of claim 19, wherein the fastener is secured to the boss using a resin.

21. The docking station of claim 14, wherein the side wall is a vertical wall that separates the fan compartment and the debris bin.

22. The docking station of claim 14, wherein the fan compartment is offset from a central axis of the base.

* * * * *